United States Patent [19]

Nishimura

[11] Patent Number: 4,827,710

[45] Date of Patent: May 9, 1989

[54] SPINNING YARN PRODUCING DEVICE

[75] Inventor: Shinichi Nishimura, Ohtsu, Japan

[73] Assignee: Murata Kikai Kabushiki Kaisha, Kyoto, Japan

[21] Appl. No.: 157,461

[22] Filed: Feb. 16, 1988

[30] Foreign Application Priority Data

Feb. 18, 1987 [JP] Japan ..... 62-35245

[51] Int. Cl.[4] ..... D01H 5/28; D01H 7/00; D02G 3/22

[52] U.S. Cl. ..... 57/328; 57/5; 57/224; 57/333

[58] Field of Search ..... 57/5, 6, 328, 333, 224, 57/210

[56] References Cited

U.S. PATENT DOCUMENTS

| | | | |
|---|---|---|---|
| 4,183,202 | 1/1980 | Mokihashi | 57/328 |
| 4,322,944 | 4/1982 | Sraitr et al. | 57/328 |
| 4,450,675 | 5/1984 | Petrov et al. | 57/5 X |
| 4,495,757 | 1/1985 | Dimitrov | 57/224 X |
| 4,507,913 | 4/1985 | Morrison | 57/328 |
| 4,598,537 | 7/1986 | Kroupa et al. | 57/5 |

*Primary Examiner*—John Petrakes

*Attorney, Agent, or Firm*—Spensley Horn Jubas & Lubitz

[57] ABSTRACT

A device for producing spinning yarn including a rotary pipe having a sliver path through which a sliver coming out from a front roller pair of a draft device is passed, a rotary plate formed integrally with and spaced from the entrance of the rotary pipe, and a casing surrounding the rotary pipe and the rotary plate. The casing has formed therein an injection nozzle which is opened obliquely toward the entrance of the rotary pipe for injecting whirling air, an air relief hole formed adjacent the rotary plate, an air whirling chamber in which air injected from the air injection nozzle whirls at a high speed, and an air relief chamber in communication with the air whirling chamber and having a gradually increasing volume.

9 Claims, 5 Drawing Sheets

SPINNING YARN PRODUCING DEVICE

BACKGROUND OF THE INVENTION

1. Field of the Invention

This invention relates to a device for producing spinning yarn, and more particularly to a device for twisting an untwisted filament sliver drafted by a draft device to produce spinning yarn.

2. Description of Related Art

Conventional spinning frames are generally divided into three types: the ring type, the open end type and the pneumatic type. Among these three types, spinning frames of the pneumatic type have been developed in recent years and have a high speed spinning faculty, as high as several times the spinning faculty of spinning frames of the ring type.

An exemplary one of such spinning frames of the pneumatic type is disclosed in Japanese Patent Publication No. 53-45422 (U.S. Pat. No. 4,112,658). In the disclosed arrangement, two air injecting nozzles are disposed in contiguous relationship to a draft device for producing compressed air flows which whirl in opposite directions to act upon a sliver coming out from the draft device. The sliver is twisted by the second nozzle, and the thus twisted sliver is ballooned by the first nozzle. By such ballooning of the sliver, some fibers of the sliver are wrapped on other fibers. Then, when the sliver passes the second nozzle and is thereupon untwisted by the same, the fibers are wrapped tightly around the other fibers. In this manner, spinning yarn is produced.

Detailed examination of yarn produced by such a pneumatic spinning frame as described above has revealed that the yarn is bundled spinning yarn, wherein some fibers are wound spirally around other untwisted or loosely twisted core fibers. The ratio in quantity between such core fibers and wound fibers, the winding manner of fibers and other yarn characteristics can be altered to some extent by variously changing operating conditions. Physical properties of the yarn, such as strength, can also be altered accordingly.

However, where the length of fibers is relatively long, it is difficult to stabilize the behavior of wrapped fibers on a pneumatic spinning frame. Further, since the pneumatic spinning frame involves two nozzles, it consumes a large amount of compressed air and has a correspondingly high energy cost. It has a further disadvantage in that its ability to spin long fibers, such as fibers of wool, is not very high.

The present invention has been made in view of such circumstances as described above, and it is an object of the present invention to eliminate such drawbacks as described above by providing a novel spinning apparatus which can replace such a conventional pneumatic spinning frame as described above.

SUMMARY OF THE INVENTION

In accordance with the present invention, these and other objectives are achieved by providing a novel device for producing spinning yarn. A preferred embodiment of the device is constituted such that it comprises a rotary pipe having a sliver path through which a sliver coming out from a front roller pair of a draft device is passed, a rotary plate formed in an integral relationship at a location spaced from an entrance of the rotary pipe, and a casing for covering the rotary pipe and the rotary plate. The casing has formed therein an injection nozzle which is opened obliquely toward the entrance of the rotary pipe for injecting whirling air and further has an air relief hole formed at a location thereof adjacent the rotary plate. The casing further has formed in the inside thereof an air whirling chamber of a small volume in which air injected from the air injection nozzle whirls at a high speed, and an air relief chamber in communication with the air whirling chamber and having a gradually increasing volume.

Fibers located at or near the central portion of a sliver coming out from the front roller pair pass through the sliver path within the rotary pipe without being substantially influenced by an air flow from the nozzle. Other fibers located at or near the outer peripheral portion of the sliver are generally acted upon by a force to separate such other fibers from the sliver due to the action of the air flow from the nozzle. Consequently, the ends of the fibers at or near the outer peripheral portion of the sliver are separated from the sliver by the whirling air flow from the nozzle. These ends are wrapped around the rotary pipe along with the whirling air flow, and further wrapped around the outer peripheries of the outer fibers introduced into the sliver path.

Air injected from the nozzle first whirls at a high speed within an air whirling chamber of relatively small volume. The air then passes through an air relief chamber, which has a gradually increasing outer diameter, whereafter it escapes externally at an appropriate speed conforming with the amount of air flowing in through the nozzle. Accordingly, the whirling air flow within the air whirling chamber is a stabilized whirling rectified flow, which promotes the whirling speed within the air whirling chamber.

BRIEF DESCRIPTION OF THE DRAWINGS

A detailed description of a preferred embodiment of the invention will be made with reference to the accompanying drawings, wherein like numerals designate corresponding parts in the several figures.

DESCRIPTION OF THE PREFERRED EMBODIMENT

The following detailed description is of the best presently contemplated mode of carrying out the invention. This description is not to be taken in a limiting sense, but is made merely for the purpose of illustrating the general principles of the invention. The scope of the invention is best defined by the appended claims.

Figure 5:
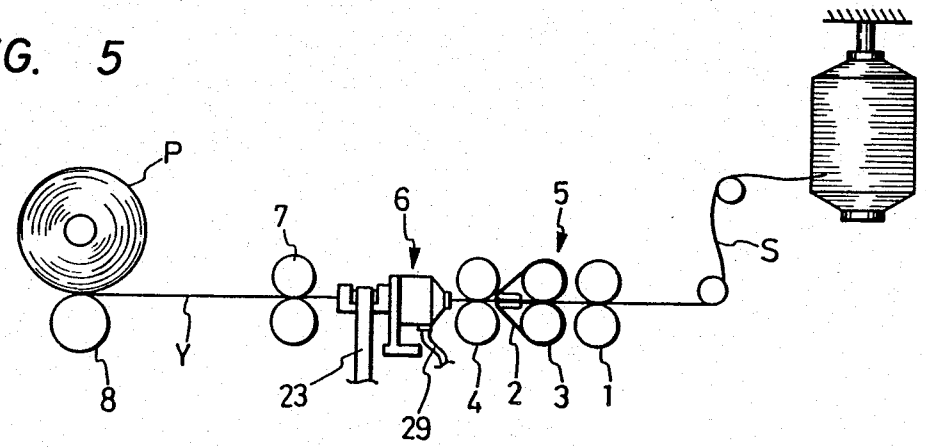
FIG. 5 is a schematic illustration of an entire spinning frame in which a preferred embodiment of the spinning device is incorporated.

FIG. 5 shows an embodiment of a spinning yarn producing device for producing wool yarn. In this embodiment, an untwisted rove of worsted yarn, that is, a sliver S wound around a bobbin B, first passes a draft device 5. The draft device 5 includes a pair of back rollers 1, a pair of middle rollers 3 each having an apron 2, and a pair of front rollers 4. The sliver S is then introduced into a spinning device 6 of the present invention by which means it is formed into spinning yarn Y. The spinning yarn Y is then drawn out by a pair of delivery rollers 7 and finally taken up onto a package P which is rotated by a friction roller 8 engaging with the spinning yarn Y.

Figure 1:
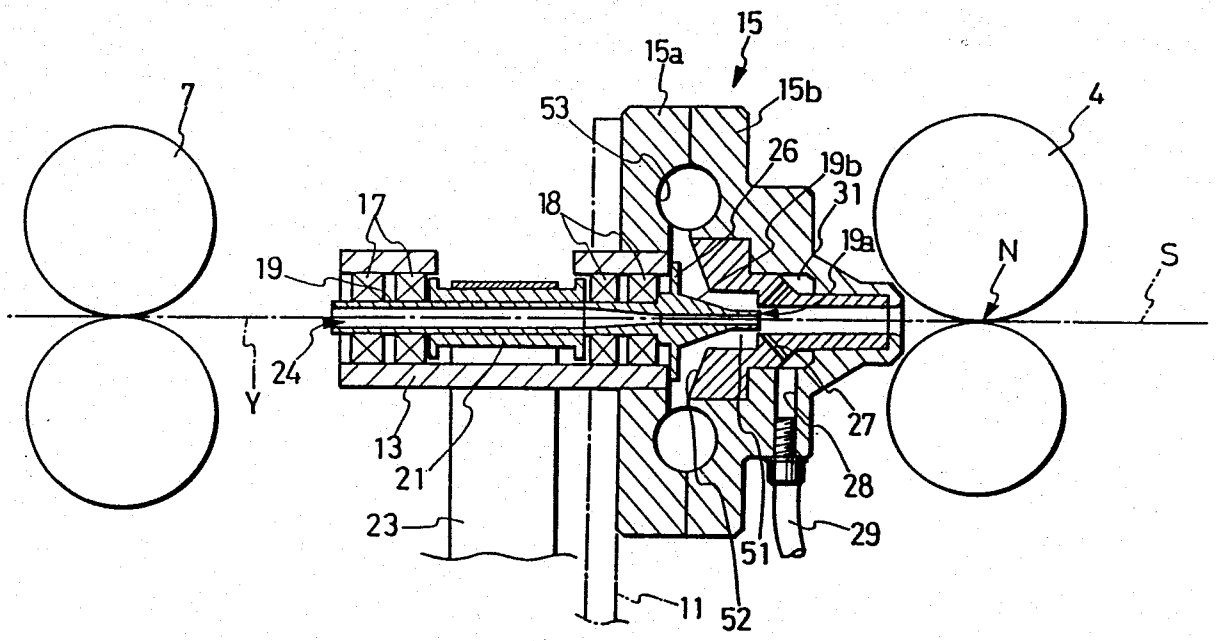
FIG. 1 is a longitudinal sectional view of a spinning device according to an embodiment of the present invention.
Figure 2:
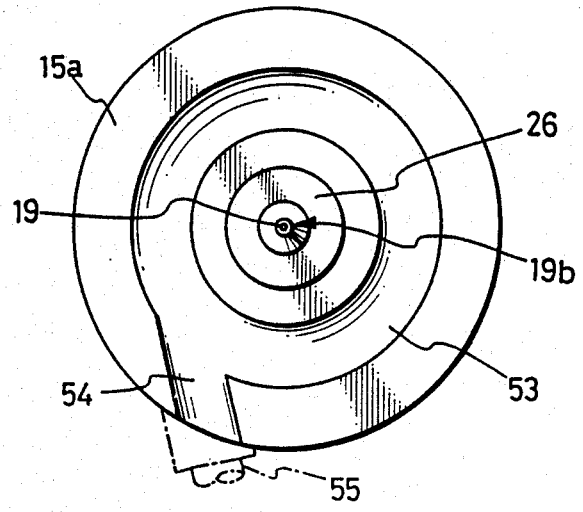
FIG. 2 is a front elevational view of a rear part of an embodiment of a casing and rotary pipe.

Some structural details of an embodiment of the spinning device 6 are shown in FIG. 1. Referring to FIG. 1, an alternate long and short dashed line indicates the path of travel of a sliver S or spinning yarn Y.

In this embodiment, a support plate 11 is secured to a frame (not shown). A bearing 13, which may be in the form of a hollow tube, is secured to the support plate 11 by a suitable means, such as a screw. A casing 15 for a rotary pipe and a rotary disk (both of which will be described in more detail hereinafter) is also secured to the support plate 11 by a suitable means, such as a screw. The casing 15 is comprised of a pair of front and rear divided parts 15*a* and 15*b*, which are screwed to each other.

A rotary pipe 19 is supported for rotation within the bearing 13 by means of a pair of bearings 17 and 18. A hollow pulley 21 is fitted on an outer periphery of the rotary pipe 19.

A drive belt 23 extends around an outer periphery of the pulley 21 and is connected to be driven in circulation by a motor (not shown). As the belt 23 circulates, the rotary pipe 19 is rotated at a relatively high speed together with the pulley 21. A rotary plate 26 is formed in integral relationship with the rotary pipe 19 at a portion of the rotary pipe 19 forward of the bearing 18.

A sliver path 24 is formed substantially at the center of the rotary pipe 19 and extends through the rotary pipe 19. The spinning device 6 is arranged such that the center of the sliver path 24 and the center of the hollow bore of the casing 15 may both be located on the same straight line, which line coincides with the path of travel of a sliver S. The distance between the entrance 19*a* of the rotary pipe 19 and the front roller point N may be smaller than the average length of fibers which form the sliver S.

The outer diameter of the entrance portion 19*a* of the rotary pipe 19 is relatively small. The outer diameter of a portion of the rotary pipe 19 contiguous to the entrance portion 19*a* varies such that it is maintained constant for a predetermined section and then increases gradually toward the rotary plate 26 in such a manner as to provide a conical configuration 19*b*. Meanwhile, a portion of the casing 15 which covers or surrounds the rotary pipe 19 and the rotary plate 26 defines therein a tubular hollow chamber 51 of a small diameter adjacent the entrance portion 19*a* of the rotary pipe 19 and a conical hollow chamber 52 contiguous to the hollow chamber 51 and opened at a great angle.

Further, a portion of the casing 15 forward of the small diameter hollow chamber 51 is in the form of a tube having a diameter slightly greater than the diameter of the end of the rotary pipe 19. The casing 15 further has formed in a position thereof diametrically outwardly of the conical hollow chamber 52 an annular hollow chamber 53 and a tangential air relief hole 54 contiguous to the hollow chamber 53.

Figure 3:
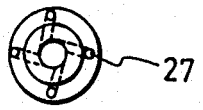
FIG. 3 is a front elevational view of an embodiment of a nozzle.

An air suction pipe 55 is connected to the air relief hole 54. A hollow air chamber 31 is formed in the casing 15*b*. Four air injection nozzles 27 are also formed in the casing 15*b* such that they are directed from the air chamber 31 toward the entrance 19*a* of the rotary pipe 19 in substantially tangential relationship to the hollow chamber 51, as shown in FIGS. 1 and 3. An air hose 29 is connected to the air chamber 31 by way of a hole 28. The directions of the nozzles 27 are arranged so that they are in substantially the same direction as the direction of rotation of the rotary pipe 19.

Compressed air supplied from the air hose 29 first flows into the air chamber 31 and is then injected into the hollow chamber 51 by way of the nozzles 27, so that high speed whirling air flows are produced near the rotary pipe entrance 19*a*.

Such air flows are first whirled within the hollow chamber 51. These air flows are then dispersed outwardly while whirling more slowly within the conical hollow chamber 52, so that they are introduced into, and discharged by way of, the relief hole 54. Simultaneously, such air flows yield suction air flows which flow from the nip point N of the front rollers 4 into the hollow bore of the casing 15.

A process of producing yarn using the embodiment of the spinning device described above will now be explained.

Figure 4:
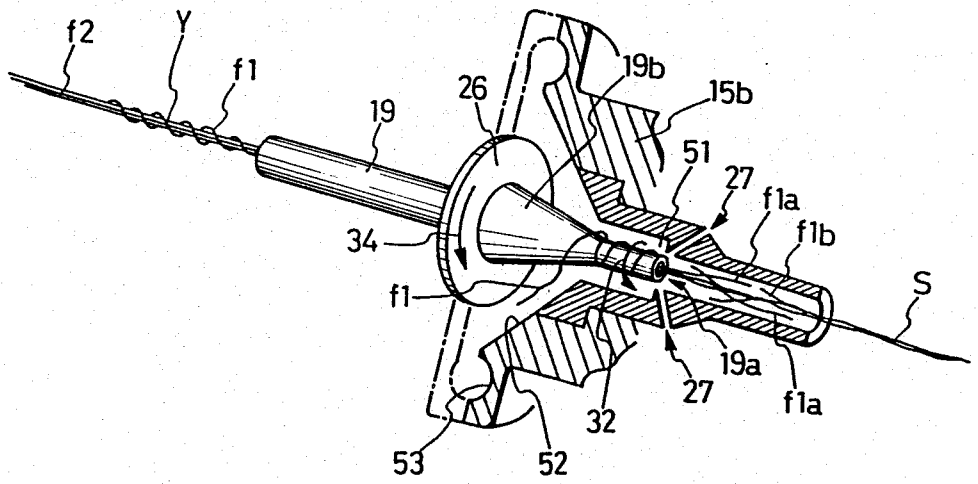
FIG. 4 is a schematic view showing a preferred process of production of spinning yarn.

Referring to FIG. 4, a sliver S drafted by the draft device 5 and fed out from the front rollers 4 is drawn into the spinning device 6 by suction air flows acting toward the inside of the hollow bore of the casing 15. Then, after passing through the sliver path 24 of the rotary pipe 19, the sliver S is drawn out by the delivery rollers 7.

During this process, the sliver S is acted upon at a position near the entrance 19*a* of the rotary pipe 19 by flows of compressed air which are injected from the air injection nozzles 27 and which whirl in a direction indicated by the arrow 32. Consequently, the sliver S is slightly twisted in the whirling direction of the air flows.

Since fibers located at or near the central portion of the sliver S are generally not exposed directly to the air flows, they are untwisted to their original condition after they have passed the pipe entrance 19*a*. In contrast, fibers f1 located at or near the outer peripheral portion of the sliver S are generally exposed directly to the air flows, and these fibers are acted upon by a force which tends to separate the fibers f1 from the sliver S. However, when the front ends of the fibers f1 are positioned adjacent the rotary pipe entrance 19*a*, they are not readily separated due to their false twists. The rear ends of the fibers are not yet separated, either because they are still held nipped between the front rollers 4 (as shown in FIG. 1) or because they are positioned far from the nozzles 27, so that they are not acted upon so much by the air flows.

Subsequently, when the rear ends of the fibers f1 are released from the front rollers 4 and approach the air injection nozzles 27, they are strongly acted upon by the force of the air flows from the nozzles 27 so that they are separated from the sliver S. Thereupon, since the front ends of the fibers f1 are partially false twisted and are received in the rotary pipe in which the air flows have little effect, they are not separated. Only the rear fiber ends f*a*, which are little acted upon by a false twisting operation, are separated from the sliver S. The rear fiber ends thus separated are wrapped in one or more turns around a portion of the rotary pipe 19 near the entrance 19*a* by the action of the air flows. These fiber ends are further wrapped a little around the conical portion 19*b* of the rotary pipe 19, whereafter they are extended outwardly under the guidance of the rotary plate 26.

Subsequently, since the sliver S continues its leftward movement (as depicted in FIG. 4), while the rotary pipe 19 is rotated in a direction indicated by the arrow 34, the rear ends f*a* of the fibers f1 are drawn out little by little while whirling around the sliver S.

As a result, the fibers fl are spirally wrapped around the sliver S, so that the sliver is formed into spinning yarn which then passes along the sliver path 24. In other words, as the sliver moves leftward, the leftward movement of the core fibers causes the free fiber ends to be released from the wrapped condition on the conical portion 19*b*. The free fiber ends are mechanically wound around the core fibers while they are turning by the rotary pipe 19. The releasing-resistant force becomes the wrapping force of the wrapping fibers around the core fibers.

In the process of production of the yarn Y described above, since the fibers f1 are separated from the outer periphery of the sliver S and consequently the fibers located inside the fibers f1 are exposed to and further separated by air flows, a large number of fibers are separated continuously. Those separated fibers are distributed uniformly over the entire periphery and the conical portion 19*b* of the rotary pipe 19. The separated fibers are thus wrapped uniformly around the fibers which make the core.

The wrapping direction of the wrapped fibers f1 is determined by the direction of rotation of the rotary pipe 19. Accordingly, when the rotary pipe 19 rotates in a direction indicated by the arrow 34, the fibers f1 are wrapped in a Z twist direction. When the rotary pipe 19 rotates in the opposite direction, the fibers f1 are wrapped in an S twist direction. The whirling direction of the air flows by the air injection nozzles 27 are preferably set so that they are in substantially the same direction as the direction of rotation of the rotary pipe 19, so that the air flows do not disturb the wrapping direction of the wrapped fibers f1 and the front ends of the fibers are not separated by whirling of the rear ends of the fibers.

Figure 6:
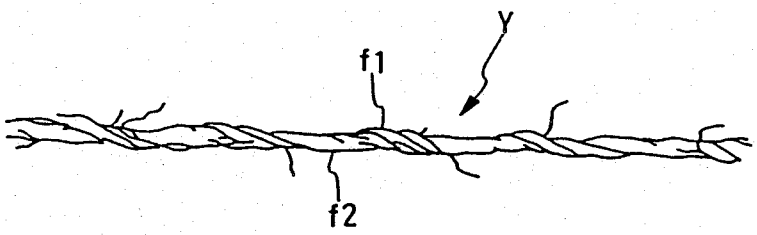
FIG. 6 is a view showing the appearance of spinning yarn produced by a preferred embodiment of the spinning device of the present invention.

FIG. 6 shows the appearance of a representative spinning yarn Y produced in accordance with the spinning process described above. The spinning yarn Y is characterized in that it has a basic structure in which the wrapped fibers f1 are wrapped spirally around the core fibers f2 and in which the arrangement of the fibers f1 and f2, and particularly the wrapped fibers f1, exhibits relatively little disorder. The number and the wrapping angle of the wrapped fibers f1 are uniform along the longitudinal direction of the yarn Y. Accordingly, the yarn Y has relatively few irregularities in thickness and relatively little fluff or loops of fluff.

In yarn produced in accordance with the present invention, it might seem as if most of the front ends f1*b* of the fibers on the surface of the sliver S would be separated from the sliver S and would wrap around the outer periphery of the sliver S. However, examination of yarn Y produced by the above described embodiment of the present invention reveals that the wrapped fibers appearing in this manner are relatively small in number. It may therefore be considered that most of the wrapped fibers have appeared because the rear ends of the fibers were separated.

While not limiting the invention to a particular mechanism, it is believed that the process in which the front ends f1b of the fibers are separated from the sliver S and form the wrapped fibers occurs as follows.

Air flows from the nozzles 27 and acts upon the fibers. The front fiber ends are generally located at or near the surface of the sliver S and, accordingly, can be separated readily. The rear fiber ends are generally located at or near the central portion of the sliver S and, accordingly, cannot be separated as readily. The front end portions of the fibers will be separated from the sliver S and wrapped around the rotary pipe 19 before they reach the pipe entrance 19*a*. The rear end portions of the fibers will remain unseparated and will generally stay in the sliver S. Then, by feeding of the sliver S and rotation of the rotary pipe 19, the fibers will be wrapped spirally on the outer periphery of the sliver S, making wrapped fibers. In such a case, the number and the wrapping angle of wrapped turns of the fibers will be similar to those which occur when the rear ends of the fibers are separated as described above.

Yarn strength is improved as the number of wrapped turns of the wrapped fibers wrapped around the outer periphery of the sliver S increases. The number of wrapped turns depends upon the whirling speed of the whirling air flows within the hollow chamber 51.

In the preferred embodiment of the present invention, the hollow chamber 51 is formed with a small diameter so that air injected from the nozzles is whirled at a very high speed, drawing a small radius. If whirling flows within the hollow chamber 51 create turbulent flows, a maximum whirling speed cannot be attained. However, since air after whirling within the hollow chamber 51 advances into the contiguous conical hollow chamber 52 and is dispersed at a suitable speed conforming to the amount of air flowing in from the nozzles, so that it is discharged smoothly into the relief hole 54, the whirling air flows within the hollow chamber 51 create stabilized rectified flows. In addition, the action caused by the high speed rotation of the rotary plate 26 to introduce air outwardly promotes smooth discharging of air within the conical hollow chamber 52.

Figure 7:
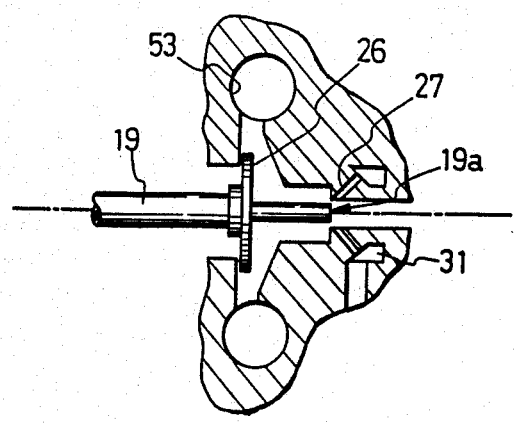
FIGS. 7 and 8 are vertical sectional side elevational views of portions of other embodiments of the present invention.
Figure 8:
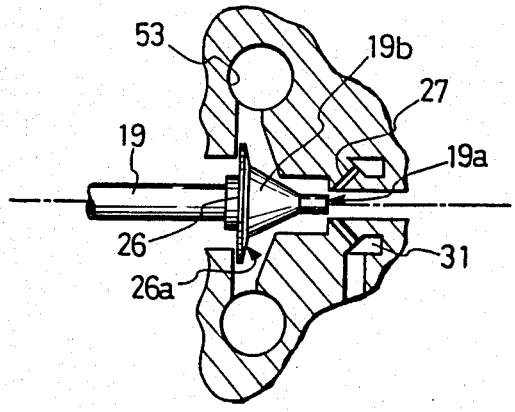

Some alternative embodiments of the present invention are illustrated in FIGS. 7 and 8. FIG. 7 shows an alternative embodiment in which a portion of the rotary plate 26 is in the form of a pipe having a fixed diameter. FIG. 8 shows another alternative embodiment in which the conical portion 19*b* of the rotary pipe 19 has a conical configuration having a greater open angle than that of FIG. 1, and the rotary plate 26 has a slope 26*a* formed at a circumferential edge thereof such that the front end portion of the rotary pipe 19 itself may have a substantially conical configuration with its bottom face at the rotary plate 26.

It is to be noted that the hollow chamber 51 of the device shown in each of FIGS. 7 and 8 has a cylindrical configuration having a relatively small diameter while the hollow chamber 52 has a conical configuration.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

As apparent from the foregoing description, the present invention provides a quite novel spinning device, and according to the present invention, spinning yarn of a high quality can be produced at a high speed without causing such problems as described above in the portion of this specification entitled Description of Related Art. Further, the present invention has succeeded in spinning at a high speed such fibers as cannot be produced readily by a conventional pneumatic spinning frame.

What is claimed is:

1. A device for producing spinning yarn from a sliver, said device comprising:

a rotary pipe having an entrance and defining a sliver path through which said sliver is passed, a rotary plate formed in integral relationship with said rotary pipe at a location spaced from said entrance of said rotary pipe, a casing substantially surrounding said rotary pipe and said rotary plate, an injection nozzle directed obliquely toward said entrance of said rotary pipe for generating whirling air in the vicinity of said entrance of said rotary pipe, an air relief hole formed in said casing at a location substantially adjacent said rotary plate, an air whirling chamber configured such that air injected into said air whirling chamber from said air injection nozzle whirls at a first speed, and an air relief chamber in communication with said air whirling chamber and having a gradually increasing volume, said air relief chamber configured such that air introduced into said air relief chamber whirls at a second speed.

2. A device for producing spinning yarn according to claim 1, wherein said injection nozzle is disposed to create whirling air flows which whirl in substantially the same direction as the direction of rotation of said rotary pipe.

3. A device for producing spinning yarn according to claim 1 or 2, wherein said air relief chamber is formed in a substantially conical shape.

4. A device for producing spinning yarn according to claim 3, wherein at least a portion of said rotary pipe has a gradually increasing outer diameter from an area adjacent the entrance of said rotary pipe toward said rotary plate.

5. A device for producing a spinning yarn according to claim 3, wherein a portion of said rotary pipe adjacent said entrance relative to said rotary plate is formed in a conical shape such that the outer diameter thereof increases toward said rotary plate.

6. A device for producing spinning yarn from a sliver, said device comprising:

a first rotary member having an aperture therein and defining a substantially cylindrical sliver path through which said sliver is passed, a second rotary member formed in integral relationship with said first rotary member at a location spaced from said aperture of said first rotary member, air injection means for generating whirling air near said aperture of said first rotary member, first chamber means in communication with said air injection means for enabling air introduced from said air injection means into said first chamber means to whirl at a first speed, second chamber means in communication with said first chamber means for enabling air introduced from said first chamber means into said second chamber means to whirl at a second speed, air relief means positioned substantially adjacent said second rotary member and in communication with said second chamber means for discharging air from said second chamber.

7. A method for producing spinning yarn from a sliver comprising the steps of:

providing a first rotary member having an aperture therein and defining a substantially cylindrical sliver path, providing a second rotary member formed in integral relationship with said first rotary member at a location spaced from said aperture of said first rotary member, passing said sliver through said aperture of said first rotary member, injecting whirling air near said aperture of said first rotary member, introducing said whirling air into a first chamber wherein said whirling air whirls at a first speed, introducing said whirling air into a second chamber in communication with said first chamber wherein said whirling air whirls at a second speed, discharging said whirling air via an air relief means positioned substantially adjacent said second rotary member and in communication with said second chamber.

8. A method of producing spinning yarn from a sliver comprising the steps of:

providing a rotary member having an aperture therein and defining a sliver path, feeding the sliver through the aperture of the rotary member, separating the fiber ends located substantially near the periphery of the sliver from the sliver, wrapping the fiber ends around the rotary member before the fiber ends are fed through the aperture of the rotary member, drawing the wrapped fiber ends gradually into the aperture of the rotary member, whereby the fiber ends are wrapped around the periphery of the sliver fed through the aperture of the rotary member.

9. A device for producing spinning yarn from a sliver comprising:

a rotary member having an aperture therein and defining a sliver path, feeding means for feeding the sliver through the aperture of the rotary member, separating means for separating the fiber ends located substantially near the periphery of the sliver from the sliver, wrapping means for wrapping the fiber ends around the rotary member before the fiber end are fed through the aperture of the rotary member, drawing means for drawing the wrapped fiber ends gradually into the aperture of the rotary member, whereby the fiber ends are wrapped around the periphery of the sliver fed through the aperture of the rotary member.

* * * * *